US005106465A

United States Patent [19]

Kaczur et al.

[11] Patent Number: 5,106,465

[45] Date of Patent: Apr. 21, 1992

[54] ELECTROCHEMICAL PROCESS FOR PRODUCING CHLORINE DIOXIDE SOLUTIONS FROM CHLORITES

[75] Inventors: Jerry J. Kaczur; David W. Cawlfield, both of Cleveland, Tenn.

[73] Assignee: Olin Corporation, Cheshire, Conn.

[21] Appl. No.: 625,753

[22] Filed: Dec. 17, 1990

Related U.S. Application Data

[63] Continuation-in-part of Ser. No. 453,552, Dec. 20, 1989.

[51] Int. Cl.[5] ..... C25B 1/26

[52] U.S. Cl. ..... 204/98; 204/95; 204/101; 204/129; 204/182.3; 204/182.4; 210/638; 423/477

[58] Field of Search ..... 204/95, 98, 101, 103, 204/129, 182.3, 182.4; 210/638; 423/477

[56] References Cited

U.S. PATENT DOCUMENTS

| | | | |
|---|---|---|---|
| 2,163,793 | 6/1939 | Logan | 204/101 |
| 2,717,237 | 9/1955 | Rempal | 204/101 |
| 2,815,320 | 12/1956 | Kollsman | 204/182.4 |
| 3,684,437 | 8/1972 | Callerame | 423/472 |
| 3,763,006 | 10/1973 | Callerame | 204/103 |
| 3,869,376 | 3/1975 | Tejeda | 204/301 |
| 3,904,496 | 9/1975 | Harke et al. | 204/98 |
| 4,432.856 | 2/1984 | Murakami et al. | 204/237 |
| 4,454,012 | 6/1984 | Bachot et al. | 204/72 |
| 4,542,008 | 9/1985 | Capuano et al. | 204/101 |
| 4,683,039 | 7/1987 | Twardowski et al. | 204/95 |
| 4,806,215 | 2/1989 | Twardowski | 204/103 |
| 4,915,927 | 4/1990 | Lipsztajn et al. | 204/103 |

FOREIGN PATENT DOCUMENTS

| | | |
|---|---|---|
| 1866 | 3/1956 | Japan . |
| 4569 | 6/1958 | Japan . |
| 714828 | 9/1954 | United Kingdom . |

*Primary Examiner*—John Niebling
*Assistant Examiner*—David G. Ryser
*Attorney, Agent, or Firm*—James B. Haglind; Paul Weinstein

[57] ABSTRACT

A process for electrolytically producing an aqueous solution of chlorine dioxide in an electrolytic cell having an anode compartment, a cathode compartment, and at least one ion exchange compartment between the anode compartment and the cathode compartment, the process comprising feeding an aqueous solution of an alkali metal chlorite to the ion exchange compartment, electrolyzing an anolyte in the anode compartment to generate hydrogen ions, passing the hydrogen ions from the anode compartment through a cation exchange membrane into the ion exchange compartment to displace alkali metal ions and produce an aqueous solution of chlorine dioxide, and passing alkali metal ions from the ion exchange compartment into the cathode compartment.

20 Claims, 2 Drawing Sheets

ELECTROCHEMICAL PROCESS FOR PRODUCING CHLORINE DIOXIDE SOLUTIONS FROM CHLORITES

This application is a continuation-in-part application of U.S. Ser. No. 07/453,552 filed on Dec. 20, 1989, pending.

BACKGROUND OF THE INVENTION

This invention relates to a process for electrochemically producing chlorine dioxide solutions. More particularly, this invention relates to the electrochemical production of chlorine dioxide solutions from alkali metal chlorite compounds.

Chlorine dioxide has found wide use as a disinfectant in water treatment/purification, as a bleaching agent in pulp and paper production, and a number of other uses due to its high oxidizing power. There are a number of chlorine dioxide generator systems and processes available in the marketplace. Most of the very large scale generators utilize a chlorate salt, a reducing agent, and an acid in the chemical reaction for producing chlorine dioxide.

Small scale capacity chlorine dioxide generator systems generally employ a chemical reaction between a chlorite salt and an acid and/or oxidizing agent, preferably in combination. Typical acids used are, for example, sulfuric or hydrochloric acid. Other systems have also used sodium hypochlorite or chlorine as the oxidizing agent in converting chlorite to chlorine dioxide. The disadvantage of the chlorine based generating systems is the handling of hazardous liquid chlorine tanks and cylinders and the excess production of chlorine or hypochlorite depending on the system operation.

The electrochemical production of chlorine dioxide has been described previously, for example, by J. O. Logan in U.S. Pat. No 2,163,793, issued June 27, 1939. The process electrolyzes solutions of an alkali metal chlorite such as sodium chlorite containing an alkali metal chloride or alkaline earth metal chloride as an additional electrolyte for improving the conductivity of the solution. The process preferably electrolyzes concentrated chlorite solutions to produce chlorine dioxide in the anode compartment of an electrolytic cell having a porous diaphragm between the anode and cathode compartments.

British Patent Number 714,828, published Sept. 1, 1954 by Farbenfabriken Bayer, teaches a process for electrolyzing an aqueous solution containing a chlorite and a water soluble salt of an inorganic oxy-acid other than sulfuric acid. Suitable salts include sodium nitrate, sodium nitrite, sodium phosphate, sodium chlorate, sodium perchlorate, sodium carbonate, and sodium acetate.

A process for producing chlorine dioxide by the electrolysis of a chlorite in the presence of a water soluble metal sulfate is taught by M. Rempel in U.S. Pat. No. 2,717,237, issued Sept. 6, 1955.

Japanese Patent Number 1866, published Mar. 16, 1956 by S. Saito et al (C.A. 51,6404, 1957) teaches the use of a cylindrical electrolytic cell for chlorite solutions having a porcelain separator between the anode and the cathode. Air is used to strip the $ClO_2$ from the anolyte solution.

Japanese Patent Number 4569, published June 11, 1958, by S. Kiyohara et al (C.A. 53, 14789d, 1959) teaches the use of a pair of membrane cells, in the first of which a concentrated $NaClO_2$ solution is electrolyzed in the anode compartment. Air is used to strip the $ClO_2$ from the anolyte which is then fed to the cathode compartment of the second cell. NaOH, produced in the cathode compartment of the first cell, is employed as the anolyte in the second cell.

A process for producing chlorine dioxide by the electrolysis of an aqueous solution of lithium chlorite is taught in U.S. Pat. No. 3,763,006, issued Oct. 2, 1973 to M. L. Callerame. The chlorite solution is produced by the reaction of sodium chlorate and perchloric acid and a source of lithium ion such as lithium chloride. The electrolytic cell employed a semi-permeable membrane between the anode compartment and the cathode compartment.

Japanese Disclosure Number 81-115883, disclosed Dec. 7, 1981, by M. Murakami et al describes an electrolytic process for producing chlorine dioxide by admixing a chlorite solution with the catholyte solution of a diaphragm or membrane cell to maintain the pH within the range of from 4 to 7 and electrolyzing the mixture in the anode compartment. The electrolyzed solution, at a pH of 2 or less, is then fed to a stripping tank where air is introduced to recover the chlorine dioxide.

More recently, an electrolytic process for producing chlorine dioxide from sodium chlorite has been described in which the chlorite ion concentration in the electrolyte is measured in a photometric cell to provide accurately controlled chlorite ion concentrations (U.S. Pat. No. 4,542,008, issued Aug. 17, 1985 to I. A. Capuano et al).

The electrolysis of an aqueous solution of alkali metal chlorate and alkali metal chloride in a three compartment electrolytic cell is taught in U.S. Pat. No. 3,904,496, issued Sept. 9, 1975 to C. J. Harke et al. The aqueous chlorate containing solution is fed to the middle compartment which is separated from the anode compartment by an anion exchange membrane and the cathode compartment by a cation exchange membrane. Chlorate ions and chloride ions pass into the anode compartment containing hypochloric acid as the anolyte. Chlorine dioxide and chlorine are produced in the anode compartment and chloride-free alkali metal hydroxide is formed in the cathode compartment.

An additional process for generating a chlorine dioxide solution from sodium chlorite passes a near neutral chlorite solution through an ion exchange column containing a mixture of both cation and anion ion exchange resins is described in U.S. Pat. No. 3,684,437, issued Aug. 15, 1972 to J. Callerame. The patent teaches that a very low conversion to chlorine dioxide is achieved by passing a chlorite solution through a column of cation ion exchange resin in only the hydrogen form.

There is therefore a need for a process which produces chlorine-free chorine dioxide solutions in a wide range of $ClO_2$ concentrations both continuously and on demand.

It is an object of the present invention to provide an improved electrolytic process for producing a chlorine dioxide solution from aqueous chlorite directly without the need for further recovery steps of the chlorine dioxide.

It is another object of the present invention to provide a process that can produce aqueous solutions of chlorine dioxide having a wide range of $ClO_2$ concentrations which are chlorine-free.

It is a further object of the present invention to provide a process for producing chlorine dioxide solutions having high conversion rates and efficiencies.

It is an additional object of the present invention to provide a process for producing chlorine dioxide solutions which does not required the storage and handling of strong acid chemicals by electro-chemically generating in-situ the required acid chemicals for efficient chlorine dioxide generation.

BRIEF DESCRIPTION OF THE INVENTION

These and other advantages are accomplished in a process for electrolytically producing an aqueous solution of chlorine dioxide in an electrolytic cell having an anode compartment, a cathode compartment, and at least one ion exchange compartment between the anode compartment and the cathode compartment, the process which comprises feeding an aqueous solution of an alkali metal chlorite to the ion exchange compartment, electrolyzing an anolyte in the anode compartment to generate hydrogen ions, passing the hydrogen ions from the anode compartment through a cation exchange membrane into the ion exchange compartment to displace alkali metal ions and produce an aqueous solution of chlorine dioxide, and passing alkali metal ions from the ion exchange compartment into the cathode compartment.

DETAILED DESCRIPTION OF THE FIGURES

Figure 1:
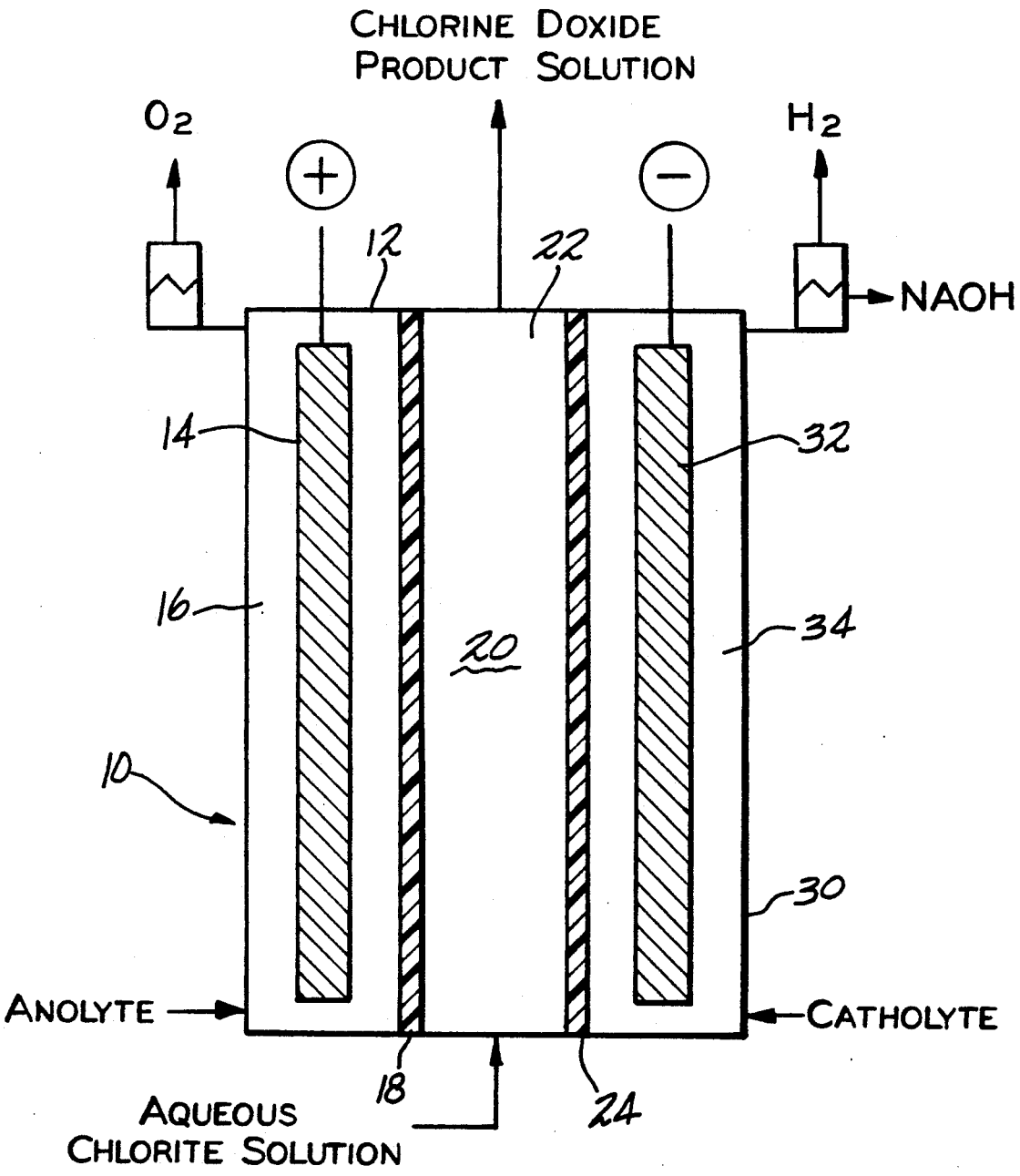
FIG. 1 is a perspective side elevational view f an electrolytic cell which can be employed in the novel process of the invention.

FIG. 1 shows an electrolytic cell 10 having anode compartment 12, ion exchange compartment 20, and a cathode compartment 30. Anode compartment 12 includes anode 14, and anolyte medium 16 Anode compartment 12 is separated from ion exchange compartment 20 by cation exchange membrane 18. Ion exchange compartment 20 includes cation exchange medium 22 and is separated from cathode compartment 30 by cation exchange membrane 24. Cathode compartment 30 includes cathode 32, and catholyte medium 34.

Figure 2:
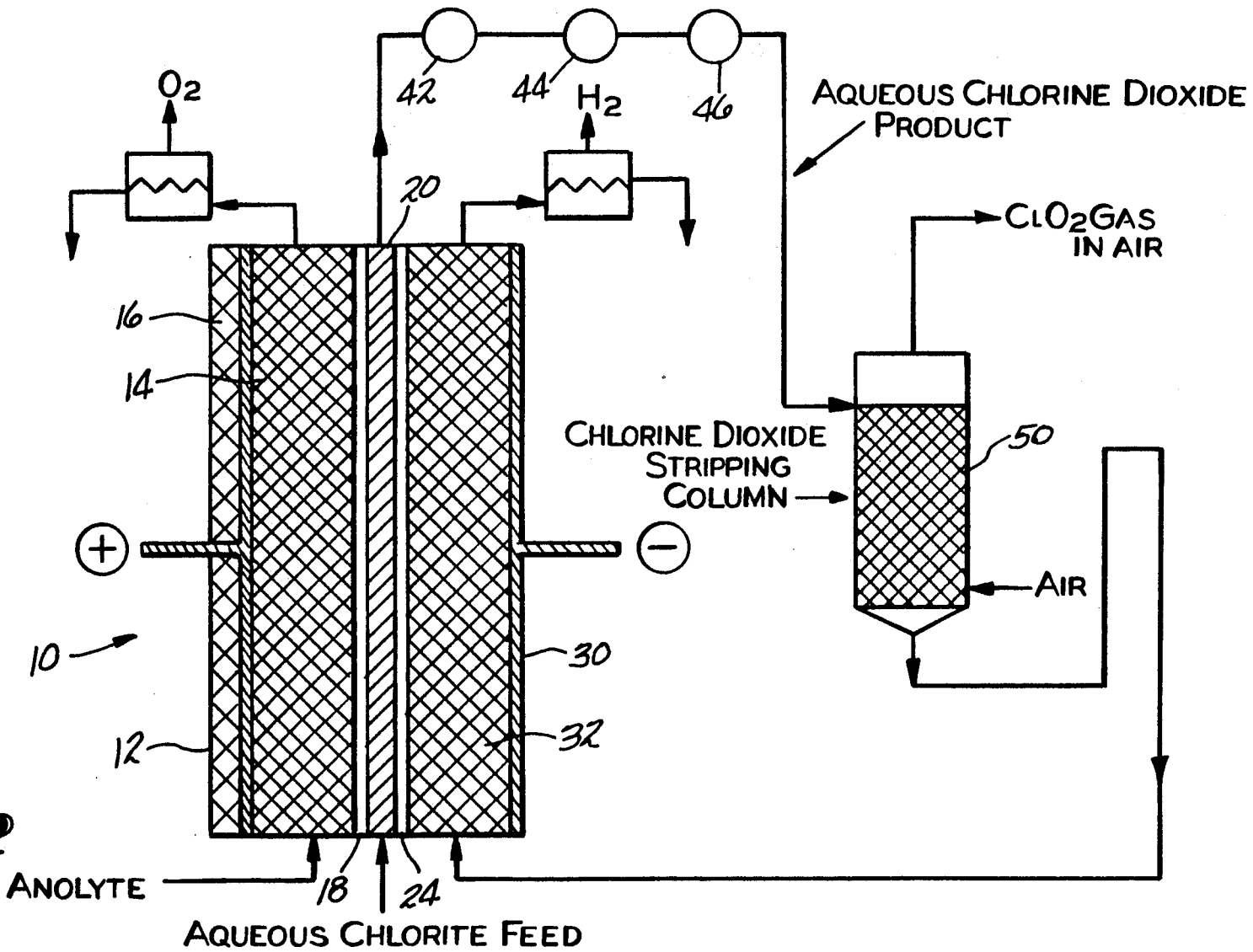
FIG. 2 is a flow diagram illustrating one embodiment of a system employing the novel process of the invention.

FIG. 2 illustrates a system employing the process of the invention in which the aqueous chlorine dioxide product solution removed from ion exchange compartment 20 is passed to $ClO_2$ separation vessel 50. The temperature, pH, and $ClO_2$ concentration of the chlorine dioxide product solution are detected at temperature sensor 42, pH detector 44, and $ClO_2$ monitor 46, respectively, prior to entry of the solution into $ClO_2$ separation vessel 50. An inert gas, such as air, is fed to $ClO_2$ separation vessel 50 to sparge $ClO_2$ from the solution. The aqueous solution is removed from $ClO_2$ separation vessel 50 and returned to cathode compartment 30.

DETAILED DESCRIPTION OF THE INVENTION

An aqueous of an alkali metal chlorite is fed to the ion exchange compartment of the electrolytic cell. Suitable alkali metal chlorites include sodium chlorite, potassium chlorite, lithium chlorite and mixtures thereof. The aqueous alkali metal chlorite solutions initially have a pH in the range of from about 7 to about 13. In order to simplify the disclosure, the process of the invention will be described, using sodium chlorite which is a preferred embodiment of the alkali metal chlorites.

The novel process of the invention utilizes an electrochemical cell to generate hydrogen ions that displace or replace alkali metal cations, such as sodium, present in the chlorite solution feed stream.

The generation of hydrogen ions in the process of the present invention in the anolyte compartment is accompanied, for example, by the oxidation of water on the anode into oxygen gas and H+ ions by the electrode reaction as follows:

$$2H_2O \rightarrow O_2 + 4H^+ + 4e^- \quad (4)$$

The anode compartment contains an anolyte, which can be any non-oxidizable acid electrolyte which is suitable for conducting hydrogen ions into the ion exchange compartment. Non-oxidizable acids which may be used include sulfuric acid, phosphoric acid and the like. Where a non-oxidizable acid solution is used as the anolyte, the concentration of the anolyte is preferably selected to match the osmotic concentration characteristics of the chlorite solution fed to the ion exchange compartment to minimize water exchange between the anode compartment and the ion exchange compartment. This also minimizes the potentiality of chlorine dioxide entering the anode compartment. Additionally, an alkali metal chloride solution can be used as the anolyte, which results in a generation of chlorine gas at the anode. Where a chlorine generating anolyte is employed, it is necessary to select the cation exchange membrane separating the anode compartment from the ion exchange compartment, which is stable to chlorine gas. The anode compartment is preferably filled with a strong acid cation exchange resin in the hydrogen form and an aqueous solution such as de-ionized water as the anolyte electrolyte.

Any suitable anode may be employed in the anode compartment, including those which are available commercially as dimensionally stable anodes. Preferably, an anode is selected which will generate oxygen gas. These anodes include porous or high surface area anodes. As materials of construction metals or metal surfaces consisting of platinum, gold, palladium, or mixtures or alloys thereof, or thin coatings of such materials on various substrates such as valve metals, i.e. titanium, can be used. Additionally precious metals and oxides of iridium, rhodium or ruthenium, and alloys with other platinum group metals could also be employed. Commercially available anodes of this type include those manufactured by Englehard (PMCA 1500) or Eltech (TIR-2000). Other suitable anode materials include graphite, graphite felt, a multiple layered graphite cloth, a graphite cloth weave, carbon, etc. A thin deposited platinum conductive coating or layer on a corrosion resistant high surface area ceramic, or high surface area titanium fiber structure, or plastic fiber substrate could also be used. Examples of conductive stable ceramic electrodes are those sold by Ebonex Technologies, Inc. under the trade name Ebonex ®.

The hydrogen ions generated pass from the anode compartment through the cation membrane into the sodium chlorite solution in the ion exchange compartment. As a hydrogen ion enters the stream, a sodium ion by electrical ion mass action passes through the cation membrane adjacent to the cathode compartment to maintain electrical neutrality.

The exchange of hydrogen ions for sodium ions is expressed in the following equations:

$$4H^+ + 4NaClO_2 \rightarrow 4HClO_2 + 4Na^+ \quad (5)$$

$$4HClO_2 \rightarrow 2ClO_2 + HClO_3 + HCl + H_2O \quad (6)$$

The novel process of the invention is operated to produce a chlorine dioxide solution in the ion exchange compartment having a pH in the range of from about 0.1 to about 4, preferably from about 0.3 to about 2.5, and more preferably, from about 0.5 to about 1.5.

The ion exchange compartment should be maintained at temperatures below which, for safety reasons, concentrations of chlorine dioxide vapor are present which can thermally decompose. Suitable temperatures are those in the range of from about 5 to about 100, preferably at from about 20 to about 80, and more preferably at from about 50° to about 70° C.

The novel process of the present invention is operated at a current density of from about 0.01 KA/m2 to about 10 KA/m2, with a more preferred range of about 0.05 KA/m2 to about 3 KA/m2. The constant operating cell voltage and electrical resistance of the anolyte and catholyte solutions are limitations of the operating cell current density that must be traded off or balanced with current efficiency and the conversion yield of chlorite to chlorine dioxide.

To promote more efficient conversion of chlorite to chlorine dioxide and to suppress chlorate ion formation, the chlorite feed solution may contain as additives or activators alkali metal salts of inorganic and organic acids. Suitable additives include inorganic alkali metal salts such as chlorides, phosphates, sulfates, nitrates, nitrites, carbonates, borates, and the like, as well as organic alkali metal salts including tartrates, citrates, acetates, formates, oxalates, gluconates, phthalates, benzoates and salicylates. Mixtures of these additives such as alkali metal chlorides and alkali metal phosphates or tartrates may be used. Potassium, sodium, and lithium are suitable as alkali metals, with sodium being preferred.

Preferred embodiments of the additives include as inorganic salts alkali metal chlorides, phosphates, and sulfates; and as organic salts alkali metal tartrates and citrates.

In the embodiment, where an additive such as an alkali metal chloride is used, the reaction is illustrated by the following equation:

$$5HClO_2 \rightarrow 4ClO_2 + H^{30} + Cl^- + 2H_2O \quad (7)$$

Any suitable amounts of the acidic alkali metal salts may be added to the alkali metal chlorite solution fed to the ion exchange compartment to increase the efficiency of the process. Maximum conversions of $NaClO_2$ to $ClO_2$ have been found, for example, where the additive is an alkali metal chloride, when the molar ratio of alkali metal chloride ion to chlorite is at least about 0.5, for example, from about 1 to about 10, and preferably from about 1.5 to about 8.5.

Current efficiencies during operation of the process of the invention can also be increased by employing additional ion exchange compartments which are adjacent and operated in series.

In an alternate embodiment the ion exchange compartment contains a cation exchange medium. Cation exchange mediums which can be used in the ion exchange compartment include cation exchange resins. Suitable cation exchange resins include those having substrates and backbones of polystyrene based with divinyl benzene, cellulose based, fluorocarbon based, synthetic polymeric types and the like.

Functional cationic groups which may be employed include carboxylic acid, sulfonic or sulfuric acids, acids of phosphorus such as phosphonous, phosphonic or phosphoric. The cation exchange resins are suitably conductive so that a practical amount of current can be passed through the cation exchange membranes used as separators. A mixture of resins in the hydrogen form and the sodium form may be used in the ion exchange compartment to compensate for the swelling and contraction of resins during cell operation. For example, percentage ratios of hydrogen form to sodium form may include those from 50 to 100%. The use of cation exchange resins in the ion exchange compartment can act as a mediator which can exchange or absorb sodium ions and release hydrogen ions. The hydrogen ions generated at the anode thus regenerate the resin to the hydrogen form, releasing sodium ions to pass into the cathode compartment. Their employment is particularly beneficial when feeding dilute sodium chlorite solutions as they help reduce the cell voltage.

Preferred as cation exchange mediums are strong acid cation exchange resins in the hydrogen form and are exemplified by low cross-linked resins such as AMBERLITE® IRC-118 (Rohm and Haas Co.) as well as higher cross-linked resins i.e. AMBERLITE® IRC-120. High surface area macroreticular or microporous type ion exchange resins having sufficient electrical conductivity, such as AMBERLYST®-19 and AMBERLYST®-31 (Rohm and Haas Co.), are also suitable as long as the cross-linking is low (for example, from about 5 to about 10%).

Physical forms of the cation exchange resin which can be used are those which can be packed into compartments and include beads, rods, fibers or a cast form with internal flow channels. Bead forms of the resin are preferred.

Cation exchange membranes selected as separators between compartments are those which are inert, flexible membranes, and are substantially impervious to the hydrodynamic flow of chlorite solution or the electrolytes and the passage of any gas products produced in the anode or cathode compartments. Cation exchange membranes are well-known to contain fixed anionic groups that permit intrusion and exchange of cations, and exclude anions from an external source. Generally the resinous membrane or diaphragm has as a matrix, a cross-linked polymer, to which are attached charged radicals such as $—SO_3^-$ and/or mixtures thereof with $—COOH^-$. The resins which can be used to produce the membranes include, for example, fluorocarbons, vinyl compounds, polyolefins, hydrocarbons, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups and membranes of vinyl compounds such as divinyl benzene. The terms "sulfonic acid group" and "carboxylic acid groups" are meant to include salts of sulfonic acid or salts of carboxylic acid groups by processes such as hydrolysis.

Suitable cation exchange membranes are readily available, being sold commercially, for example, by Ionics, Inc., RAI Research Corp., Sybron, by E. I Du-Pont de Nemours & Co., Inc., under the trademark "NAFION ®", by the Asahi Chemical Company under the trademark "ACIPLEX ®", and by Tokuyama Soda Co., under the trademark "NEOSEPTA ®".

The catholyte can be any suitable aqueous solution, including alkali metal chlorides, and any appropriate acids such as hydrochloric, sulfuric, phosphoric, nitric, acetic or others. In a preferred embodiment, ionized or softened water or sodium hydroxide solution is used as the catholyte in the cathode compartment to produce a chloride-free alkali metal hydroxide. The water selection is dependent on the desired purity of the alkali metal hydroxide by-product. The cathode compartment may also contain a strong acid cation exchange resin.

Any suitable cathode which generates hydrogen gas may be used, including those, for example, based on nickel or its alloys, including nickel-chrome based alloys; steel, including stainless steel; tantalum, tin, titanium, zirconium, iron, copper, other transition metals and alloys thereof. Precious metals, such as gold and silver, preferably in the form of coatings, could also be used. Additionally, a multiple layered graphite cloth, a graphite cloth weave, carbon, including felt structures of graphite or metals such as stainless steel. The cathode is preferably perforated to allow for suitable release of the hydrogen gas bubbles produced at the cathode particularly where the cathode is placed against the membrane.

Preferred embodiments of cathodes for use in the process of the invention are high surface area cathodes. High surface area cathodes can be formed from any of the above-named materials in the form of felts, matted fibers, semi-sintered powders, woven cloths, foam structures or multiple layers of thin expanded or perforated sheets. The high surface area cathode can also be constructed in a gradient type of structure, that is using various fiber diameters and densities in various sections of the cathode structure to improve performance or reduce flow pressure drop through the structure. The gradient structure can also be used to enhance the current distribution through the structure. The high surface area cathode can be sintered to the cathode current distributor backplate as a unit. It is preferable to have a removable structure for ease of cathode maintenance and replacement.

The cathode material preferably should be of the non-sacrificial type. A sacrificial type, such as an iron based material in the form of steel wool, could be used but would suffer from the disadvantage of corroding during periods of non-use or non-operation. Another sacrificial type of material is titanium, which suffers from the disadvantage of hydriding during operation. The high surface area cathode should preferably be formed of a high hydrogen overvoltage material. Materials with high hydrogen overvoltages have increased current efficiency and promote the desired reduction of the chlorite and chlorate ions to chloride. The cathode can be coated or plated with oxides, such as ruthenium or other precious metal oxides, to enhance or catalyze the electroreductive conversion to chloride ions. The cathode surface area is especially important with one pass or single flow through processing. The specific surface area of the cathode structure can range from about 5 $cm^2/cm^3$ to about 2000 $cm^2/cm^3$, and more preferably, from about 10 $cm^2/cm^3$ to about 1000 $cm^2/cm^3$. The high surface area density can range from about 0.5% to about 90% or more preferably from about b 1% to about 80%, with an optimum range being from about 2 about 50%. The lower the density of the of the stream through the cathode structure.

A thin protective spacer such as a chemically resistant plastic mesh can be placed between the membrane and the anode surface to provide for use of expanded metal anodes when using a liquid anolyte in the anode compartment. A spacer can also be used between the cathode and cation exchange separating the ion exchange compartment from the cathode compartment membrane.

It will be recognized that other configurations of the electrolytic cell can be employed in the novel process of the present invention, including those having additional ion exchange compartments between the anode and cathode compartments as well as bipolar cells using a solid plate type anode/cathode. For example, a bipolar electrode could include a valve metal such as titanium or niobium sheet clad to stainless steel. The valve metal side could be coated with an oxygen evolution evaluation catalyst and would serve as the anode. An alternative anode/cathode combination is a platinum clad layer on stainless steel or niobium or titanium which is commercially available and is prepared by heat/pressure bonding.

In these configurations, separators or spacers may be used between the cation exchange membranes and the electrodes to provide a gas release zone.

Chlorine-free chlorine dioxide solutions produced by the process of the invention include those of a wide range of $ClO_2$ concentrations (gm/l.), for example from about 0.1 to about 100 gm/1., with preferred chlorine dioxide solutions containing $ClO_2$ concentrations of from about 0.5 to about 80, and more preferably from about 1 to about 50 gm/1. As the concentration of $ClO_2$ increases, it is advisable to adjust process parameters such as the feed rate of the alkali metal chlorite solution and/or the current density to maintain the temperature of the ion exchange compartment within the more preferred temperature range as described above.

Where stronger chlorine dioxide product solutions are required, it is possible to obtain the desired product by using a higher concentration sodium chlorite feed solution of, for example, from about 50 to about 70 g/l in conjunction with an above atmospheric pressure in the cell 10. The higher pressure, from about 1.2 to about 5 atmospheres, is necessary to prevent the potentially explosive chlorine dioxide at concentrations of above about 50 g/l from coming out of solution into the explosive vapor phase.

The chlorine dioxide solutions produced by the process of the invention are removed from the ion exchange compartment having a pH in the range of from about 0.5 to about 1.5. and a temperature in the range of from about 50° to about 65° C.

Preferably, the chlorine dioxide solutions produced have substantially no residual chlorite concentration. Where a chlorite residual concentration is present, passing the solution into a holding vessel to permit the reactions to go to completion may be desirable. Suitable holding vessels include pipes, tanks, etc., which may have packing to increase the residence time and to prevent back mixing.

In one embodiment, the chlorine dioxide present in the solution produced by the process of the invention is converted to chlorine dioxide gas, for example, by sparging the solution with air or an inert gas such as nitrogen, or by vacuum extraction. The remaining solution which may contain chlorate or residual chlorite ions is fed to the cathode compartment of the electrolytic cell where these ions are electrochemically reduced to chloride ions in the catholyte solution which can be readily used or disposed of by environmentally acceptable methods.

To further illustrate the invention the following examples are provided without any intention of being limited thereby. All parts and percentages are by weight unless otherwise specified.

EXAMPLES 1-4

An electrochemical cell of the type shown in FIG. 1 was employed having an anode compartment, a central ion exchange compartment, and a cathode compartment. The anode compartment contained a titanium mesh anode having an oxygen-evolving anode coating (PMCA 1500® Englehard Corporation, Edison, N.J.) The anode compartment was filled with a strong cation exchange resin (AMBERLITE®, IRC-120+, Rohm & Haas Co., Philadelphia., Penna.) in the hydrogen form. The ion exchange compartment was filled with AMBERLITE® IRC-120+, in the hydrogen form. The cathode compartment contained a stainless steel perforated plate cathode. The cathode compartment was initially filled with a sodium hydroxide solution (2% by weight) as the catholyte. Separating the anode compartment from the ion exchange compartment, and the ion exchange compartment from the cathode compartment were a pair of hydrocarbon based cation exchange membranes (NEOSEPTA® C-6610F, Tokuyama Soda Co.) having sulfonic acid ion exchange groups. In the cathode compartment a thin polyethylene separator was placed between the cation exchange membrane and the cathode. During operation of the electrolytic cell, an aqueous sodium chlorite solution containing 10.5 g/l of $NaClO_2$ was prepared from a technical solution (Olin Corp. Technical sodium chlorite solution 31.25). To this solution was added NaCl to provide a molar ratio of NaCl: $NaClO_2$ of 1.75. The chlorite solution was continuously metered into the bottom of the ion exchange compartment. As the anolyte, deionized water was fed to the anode compartment, and deionized water was fed as the catholyte to the cathode compartment. The cell was operated at varying cell currents, cell voltages, and residence times to produce aqueous chlorine dioxide solutions. Periodically a sample of the product solution was taken and analyzed for chlorine dioxide and sodium chlorite content. The collected samples of product solution were stored in a sealed container and analyzed after specified time periods. The results are given in Table I below.

EXAMPLES 5

The procedure of Examples 1-4 was followed exactly with the exception that the aqueous sodium chlorite feed solution (10.5 g/l) contained NaCl in an amount which provided a molar ratio of NaCl to $NaClO_2$ of 3.23. The results are given in Table 1 below.

EXAMPLES 6

The procedure of Examples 1-4 was followed exactly with the exception that the aqueous sodium chlorite feed solution contained 5 g/l of $NaClO_2$ and NaCl in an amount which provided a molar ratio of NaCl to $NaClO_2$ of 3.23. The results are given in Table 1 below.

EXAMPLE 7

The cathode compartment of the electrolytic cell of Examples 1-6 was filled with a strong cation exchange resin (AMBERLITE®, IRC-120+, Rohm & Haas Co., Philadelphia, Penna.) in the sodium form. Separating the anode compartment from the ion exchange compartment, and the ion exchange compartment from the cathode compartment were a pair of fluorocarbon based cation exchange membranes (NAFION®117, DuPont Co.) having sulfonic acid ion exchange groups. The procedure of Examples 1-4 was followed exactly with the exception that the aqueous sodium chlorite feed solution contained 10.1 g/l of $NaClO_2$ and NaCl in an amount which provided a molar ratio of NaCl to $NaClO_2$ of 4.88. The results are given in Table 1 below.

EXAMPLE 8

The procedure of Example 7 was followed exactly with the exception that NaCl was not added to the aqueous sodium chlorite feed solution (10 g/l). The results are given in Table 1 below.

EXAMPLE 9

The procedure of Example 7 was followed exactly using a sodium chlorite solution containing 20 g/l of $NaClO_2$ and NaCl in an amount which provided a molar ratio of NaCl to $NaClO_2$ of 1.83. The results are given in Table 1 below.

An electrochemical cell of the type shown in FIG. 1 was employed consisting of an anode compartment, a central ion exchange compartment, and a cathode compartment.

The anode compartment contained a 0.060 inch (0.152 cm.) thick titanium expanded metal mesh anode which had been electroplated with a thin platinum metal coating (approximately 1 micron in thickness) on both sides. Two titanium metal posts previously welded to the flat expanded anode were used to conduct the current to the anode from a DC power supply source. The anode surface was positioned to be in contact with the surface of a perfluorinated cation ion exchange sulfonic acid membrane (Nafion® 117 E. I. DuPont de Nemours) positioned between the anode and the central ion exchange compartment using two layers of 0.030 inch (0.076 cm.) thick polypropylene mesh having ¼ inch (0.625 cm.) square hole openings behind the anode. The plastic spacer mesh provided both a means for the positioning the anode and for disengaging oxygen gas from the anode compartment.

The central ion exchange compartment consisted of a ⅛" (0.318 cm.) thick compartment with inlet and outlet ports with a series of drilled holes to evenly distribute the aqueous chlorite feed flow in the compartment. Three layers of a polypropylene spacer material with ⅛" square holes (⅛" thickness total) was used to distribute the aqueous chlorite feed in the compartment and to physically support the cation exchange membranes.

The cathode compartment contained as the cathode a perforated 304 stainless plate with two welded stainless conducting posts. The cathode surface was in contact with a perfluorinated cation ion exchange sulfonic acid membrane (Nafion® 117 E. I. DuPont de Nemours) positioned between the cathode and the central ion exchange compartment using the same type of polypropylene spacers as used in the anode compartment. The positioning of the anode and the cathode structures against the cation exchange membranes to provided a zero gap cell configuration.

The anode compartment was initially filled with deionized water and was kept at a constant height volume during cell operation. The cathode compartment was fed by a continuous flow of softened water at a rate of about 10 gm/min.

A concentrated stock feed solution containing 12.5 wt% $NaClO_2$ and 15.25 wt% NaCl, having a molar ratio of NaCl:$NaClO_2$ of about 1.89, was prepared from a 31.25 wt% of a sodium chlorite solution (Olin Corporation, Stamford, Conn.) and a purified saturated NaCl brine solution. The stock solution was metered into a 40 gm/min flow of softened water to produce an aqueous chlorite feed having a concentration of about 10.75 gm/l as $NaClO_2$.

The applied cell current was set at a constant 15 amperes for an operating current density of 0.65 KA/m2. The cell voltage stabilized at 6.5 volts.

The aqueous chlorine dioxide solution product recovered from the outlet in the central ion exchange compartment at a temperature of about 33 degrees C., a pH of 1.15, and at a mass flow rate of about 44 gm./min. The solution was analyzed and found to have 2.85 gm/l $ClO_2$ with about 4.70 gm/l of residual chlorite. The NaOH concentration in the catholyte was analyzed to be 2.04 wt%.

The $ClO_2$ product solution was piped to the bottom of a polyethylene filter housing filled with ¼ inch (0.625 cm) ceramic saddles which provided a suitable plug flow for the chlorine dioxide product solution at a defined rate. The filter housing had a void space volume of about 2000 ml.

The residence time in the polyethylene filter was estimated to be about 45 minutes. The product solution from the top exit was analyzed to contain 6.74 gpl $ClO_2$ with no residual $NaClO_2$. The chlorine dioxide yield from the sodium chlorite feed input was calculated to be 84%, slightly higher than the theoretical yield of 80% based on the chemical reaction illustrated by equation (5).

EXAMPLE 11

The procedure of Example 1 was employed using the electrochemical cell of the Example 10. The chlorite feed to the central ion exchange compartment was a premixed aqueous solution containing 10.7 gm/l $NaClO_2$ and 19.5 gm/l NaCl (molar ratio of NaCl: $NaClO_2$ 2.82) was metered into the cell at a mass flow rate of 26.8 gm/min. The cell current applied was 15 amperes at a current density of 0.65 $KA/m^2$ and a cell voltage of 5.8 volts. The aqueous chlorine dioxide solution product from the outlet of the ion exchange compartment was at a temperature of about 35° C. and a pH of 1.01. The aqueous chlorine dioxide solution contained 5.60 gm/l. $ClO_2$ and no residual chlorite for a chlorine dioxide yield (based on chlorite) of 69.8%.

EXAMPLE 12

The procedure of Example 11 was employed in the electrolytic cell of Example 10. The cell was operated at an applied current of 20 amperes and a current density of 0.87 $KA/m^2$ with the cell voltage at 7.3 volts.

The aqueous chlorine dioxide product at the outlet of the ion exchange compartment had a pH of 0.80 and temperature of 45° C. The product was analyzed to contain 6.10 gm/l chlorine dioxide with no residual chlorite for a chlorine dioxide yield of about 76% based on chlorite.

TABLE I

| | | Electrochemical Production of Chlorine Dioxide Solution | | | | | | | | |
|---|---|---|---|---|---|---|---|---|---|---|
| | | Cell Feed | | Cell | Product Solution | | | | | |
| | Time (Min) | Cell Volts | Cell Amps | Flowrate g/min | Residence Time (min) | ClO2 gpl | NaClO2 gpl | Temp °C. | pH | Percent Conversion To Chlorine Dioxide |
| Example No. 1 | 0 | 9.2 | 8.0 | 31.0 | 3.7 | 2.52 | 4.25 | 39 | 1.50 | 32.2 |
| Stored Sample | 30 | — | — | — | | 4.37 | -0- | 25 | 1.60 | 55.8 |
| Stored Sample | 60 | — | — | — | | 4.76 | -0- | 25 | 1.62 | 60.8 |
| Example No. 2 | 0 | 12.4 | 12.0 | 31.0 | 3.7 | 3.04 | 2.47 | 50 | 1.47 | 38.7 |
| Stored Sample | 60 | — | — | — | | 4.39 | -0- | 25 | 1.55 | 55.9 |
| Example No. 3 | 0 | 5.7 | 5.0 | 46.3 | 2.5 | 1.79 | 3.83 | 31 | 1.98 | 22.9 |
| Stored Sample | 30 | — | — | — | | 3.30 | 1.89 | 25 | 2.22 | 42.1 |
| Stored Sample | 60 | — | — | — | | 4.22 | -0- | 25 | 2.38 | 53.9 |
| Example No. 4 | 0 | 7.7 | 8.0 | 16.5 | 7.0 | 3.42 | 1.65 | 43 | 1.35 | 43.7 |
| Stored Sample | 30 | — | — | — | | 4.48 | -0- | 25 | 1.40 | 57.2 |
| Example No. 5 | 0 | 9.0 | 12.0 | 31.0 | 3.7 | 4.26 | 1.25 | 50 | 1.20 | 54.4 |
| Stored Sample | 30 | — | — | — | | 5.10 | -0- | 25 | 1.51 | 65.1 |
| Example No. 6 | 0 | 9.0 | 10.0 | 19.0 | 6.1 | 2.30 | — | 51 | 2.03 | 58.7 |
| Example No. 7 | 0 | 7.3 | 10.0 | 20.0 | 5.75 | 4.30 | 1.16 | 44 | 1.17 | 58.8 |
| Stored Sample | 30 | — | — | — | | 4.90 | 0.10 | 25 | 1.30 | 65.0 |
| Example No. 8 | 0 | 8.52 | 10.0 | 20.0 | 5.75 | 2.30 | 2.93 | 49 | 1.52 | 30.8 |
| Stored Sample | 30 | — | — | — | | 2.40 | 2.45 | 25 | 1.60 | 32.2 |
| Example No. 9 | 0 | 8.1 | 14.0 | 19.8 | 5.80 | 8.69 | 1.03 | 52 | 1.20 | 58.3 |
| Stored Sample | 30 | — | — | — | | 9.17 | -0- | 25 | 1.05 | 61.5 |

What is claimed is:

1. A process for electrolytically producing an aqueous solution of chlorine dioxide in an electrolytic cell having an anode compartment, a cathode compartment, and at least one ion exchange compartment between the anode compartment and the cathode compartment, the process which comprises feeding an aqueous solution of an alkali metal chlorite to the ion exchange compartment, electrolyzing an anolyte in the anode compartment to generate hydrogen ions, passing the hydrogen ions from the anode compartment through a cation exchange membrane into the ion exchange compartment to displace alkali metal ions and produce an aqueous solution of chlorine dioxide passing alkali metal ions from the ion exchange compartment into the cathode compartment, removing the aqueous solution of chlorine dioxide from the ion exchange compartment, separating chlorine dioxide gas from an aqueous solution having reduced concentrations of alkali metal chlorite, and feeding the aqueous solution to the cathode compartment.

2. The process of claim 1 in which the aqueous solution of chlorine dioxide has a pH in the range of from about 0.1 to about 3.

3. The process of claim 1 characterized in that the anolyte is a certain exchange resin in the hydrogen form and water.

4. The process of claim 1 in which the anolyte is an aqueous solution a non-oxidizable acid.

5. The process of claim 1 in which the aqueous solution of alkali metal chloride is selected from the group consisting of sodium chlorite, potassium chlorite, lithium chlorite and mixtures thereof.

6. The process of claim 5 in which the aqueous solution of alkali metal chlorite is sodium chlorite.

7. The process of claim 6 in which the aqueous solution of sodium chlorite contains as an activator or alkali metal salt selected from the group consisting of chlorides, phosphates, sulfates, tartrates, citrates, and mixtures thereof.

8. The process of claim 7 in which the molar ratio of the alkali metal salt to sodium chlorite is at least 0.5.

9. The process of claim 8 in which the aqueous solution of sodium chlorite has a pH in the range of from about 7 to 13.

10. The process of claim 9 in which the alkali metal salt is an alkali metal chloride.

11. The process of claim 10 in which the alkali metal chloride is sodium chloride.

12. The process of claim 11 in which the molar ratio of sodium chloride to sodium is from about 1.5 to about 8.5.

13. The process of claim 8 in which the cathode compartment contains as the catholyte a cation exchange resin in the alkali metal form.

14. The process of claim 1 in which the ion exchange compartment contains a cation exchange resin in the hydrogen form.

15. The process of claim 1 in which the cathode compartment contains water or an alkali metal hydroxide solution.

16. The process of claim 1 in which oxygen gas is produced in the anode compartment.

17. The process of claim 1 in which hydrogen gas as produced in the cathode compartment.

18. The process of claim 1 in which the aqueous solution of alkali metal chlorite contains as an activator an alkali metal salt selected from the group consisting of chlorides, phosphates, sulfates, nitrates, nitrites, carbonates, borates, tartrates, citrates, acetates, formates, oxalates, gluconates, phthalates, benzoates, salicylates, and mixtures thereof.

19. The process of claim 1 in which the current density is from about 0.1 to about 10 $KA/m^2$.

20. The process of claim 1 in which the electrolysis is conducted at above atmospheric pressure.

* * * * *

UNITED STATES PATENT AND TRADEMARK OFFICE

CERTIFICATE OF CORRECTION

PATENT NO. : 5,106,465

DATED : April 21, 1992

INVENTOR(S) : Kaczur et al

It is certified that error appears in the above-indentified patent and that said Letters Patent is hereby corrected as shown below:

At column 2, line 57, delete "chorine" and insert --chlorine.

At colum 3, line 6, delete "required" and insert --require--.

At column 3, line 30, delete "f" and insert --of--.

At column 3, line 64, between "aqueous" and "of an alkali" insert --solution--.

At column 8, line 4, after "density of the" please insert --high surface density area material, the lower is the flow pressure drop--.

At column 5, line 52, formula (7) please delete "$5HClO_2$ -- $4ClO_2 + H^{30} + Cl^- + 2H_2O$" and insert --$5HClO_2$ -- $4ClO_2 + H^+ + Cl^- + 2H_2O$--.

At column 8, lines 22-23, please delete "evaluation".

At column 10, line 31, please insert the heading --EXAMPLE 10--.

At column 13, line 5, delete "certain" and insert --cation--.

At column 14, line 2, between "chloride to sodium" and "is from about" insert --chlorite--.

UNITED STATES PATENT AND TRADEMARK OFFICE

CERTIFICATE OF CORRECTION

PATENT NO. : 5,106,465

DATED : April 21, 1992

INVENTOR(S) : Kaczur et al

It is certified that error appears in the above-indentified patent and that said Letters Patent is hereby corrected as shown below:

At column 13, line 16 between "activator" and "alkali" insert --an--.

At column 13, line 8, between "solution" and "a non-oxidizable" insert --of--.

Signed and Sealed this

Seventh Day of September, 1993

Bruce Lehman

*Attest:*

BRUCE LEHMAN

*Attesting Officer*

*Commissioner of Patents and Trademarks*